US005632308A

United States Patent [19]

Bucher et al.

[11] Patent Number: 5,632,308

[45] Date of Patent: May 27, 1997

[54] METHOD FOR THE METERED INSERTION OF WEFT YARN INTO A SERIES SHED WEAVING MACHINE

[75] Inventors: Robert Bucher, Frick; Ernst Eberhard, Wolfhausen, both of Switzerland

[73] Assignee: Sulzer Rueti AG, Rueti, Switzerland

[21] Appl. No.: 414,414

[22] Filed: Mar. 31, 1995

[30] Foreign Application Priority Data

May 30, 1994 [EP] European Pat. Off. ..... 94810315

[51] Int. Cl.[6] ..... D03D 41/00

[52] U.S. Cl. ..... 139/28; 139/450

[58] Field of Search ..... 139/28, 436, 450

[56] References Cited

U.S. PATENT DOCUMENTS

| | | | |
|---|---|---|---|
| 4,592,393 | 6/1986 | Steiner | 139/28 X |
| 5,103,876 | 4/1992 | Benz et al. | 139/28 |
| 5,146,955 | 9/1992 | Steiner | 139/450 |
| 5,406,985 | 4/1995 | Christe | 139/28 X |

FOREIGN PATENT DOCUMENTS

| | | |
|---|---|---|
| 0445489 | 9/1991 | European Pat. Off. . |
| 0498773 | 8/1992 | European Pat. Off. . |
| 0554222 | 8/1993 | European Pat. Off. . |
| 4226693 | 2/1993 | Germany . |

*Primary Examiner*—Andy Falik

*Attorney, Agent, or Firm*—Townsend and Townsend and Crew LLP

[57] ABSTRACT

Weft yarn is inserted into the weaving rotor of a series shed weaving machine. Four weft yarns (7; 71, 72, 73, 74) are conveyed into the weft yarn distribution apparatus (9) from four supply units (2*a*–2*d*) and four metering apparatuses (1*a*–1*d*). The weft yarn distribution apparatus (9) distributes the weft yarns (71–74) delivered to it to the sheds of the weaving rotor (100) which are currently open, with the weft yarns being inserted through stationary fluid nozzles (91, 92, 93, 94) into the rotating weaving rotor (100). During normal operation of the series shed weaving machine, the weft yarn (71–74) is continuously pulled from the weft yarn supply (2*a*–2*d*) by the metering apparatuses (1*a*–1*d*) and conveyed to the weft yarn distribution apparatus (9) which conducts the weft yarn (71–74) into an opened shed (103*a*–103*d*). The speed of conveyance of the weft yarn (71–74) during insertion into the shed (103*a*–103*d*) is thus determined by the metering apparatus (1*a*–1*d*).

18 Claims, 4 Drawing Sheets

METHOD FOR THE METERED INSERTION OF WEFT YARN INTO A SERIES SHED WEAVING MACHINE

BACKGROUND OF THE INVENTION

The invention relates to a method for inserting weft yarns into a series shed weaving machine as well as to a series shed weaving machine operated with the method of the invention.

The insertion of weft yarn in series shed weaving machines requires fast, accurate yarn insertions in quick successions. Not only must the weft yarn be inserted, for high quality weaving the inserted weft yarn must be straight and, following insertion, the yarn must be severed from the yarn supply for insertion in the next shed.

U.S. Pat. No. 5,103,876 discloses a device for the metering of weft yarn during weaving. This patent discloses an arrangement capable of automatically threading the weft yarn following a yarn break and to automatically provide new weft yarn into a programmed start position so that weaving can continue. A roller-type metering device cooperates with components such as a catcher, a deflector or an injection nozzle which are all provided to automatically remove the broken weft yarn and supply the metering device with new yarn.

SUMMARY OF THE INVENTION

It is an object of the invention to provide a method and an apparatus for inserting weft yarns into the weaving rotor of a series shed weaving machine which allow a reliable insertion of the weft yarn.

Generally speaking, the present invention employs a metering device, for example of the type disclosed in U.S. Pat. No. 5,103,876, which cooperates with fluid nozzles disposed downstream of the metering device. The nozzle discharges fluid jets that carry the weft yarn into the open shed of a series shed weaving machine. The fluid jets have sufficient pressure so that they urge the weft yarn into the shed while they apply tension to the weft yarn as the weft yarn is payed out from the metering device. Thus, it is the metering device, and not the relatively high-speed fluid jets, which determines the insertion speed of the weft yarn.

This is a distinct advantage provided by the invention because the speed of insertion can thus be exactly prespecified and varied via a control of feedback control apparatus. The method of the invention allows the weft yarn insertion to be monitored with sensors and to be influenced with actuators so that a reliable insertion of the weft yarn is achieved.

Additionally, the metering apparatus allows the length of the weft yarn which has been inserted to be continuously measured so that the location of the tip of the yarn can be continually calculated and is thus known. The speed of yarn insertion can be varied during a weft insertion, for example in a manner that the speed is increased over a first section of the insertion and reduced in a subsequent section so that via the retardation the weft yarn is additionally stretched in the subsequent section.

BRIEF DESCRIPTION OF THE DRAWINGS

The invention is described in the following by means of example only with reference to illustrated embodiments. The drawings

DESCRIPTION OF THE PREFERRED EMBODIMENTS

Figure 4:
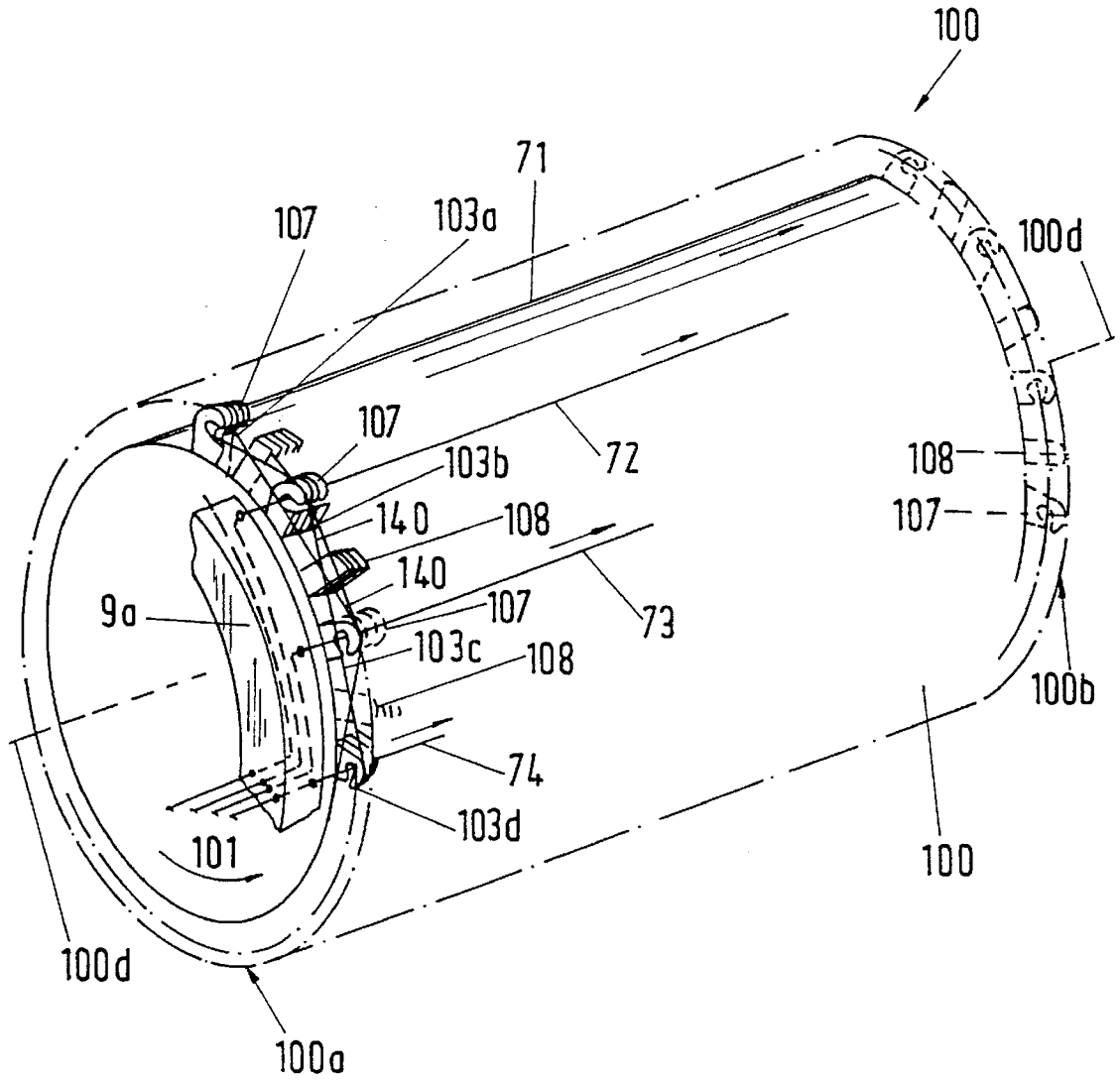
FIG. 4 is a perspective view of a weaving rotor.

FIG. 4 shows a weaving rotor 100 of a series shed weaving machine in a perspective view. The weaving rotor 100 which rotates about the rotational axis 100*d* in the direction of movement 101 comprises shed formation members 107 which act on the warp yarns in such a way that they form an open shed 103*a*, 103*b*, 103*c*, 103*d*, into which a weft yarn 71, 72, 73, 74 can be inserted. The weft insertion takes place by means of a fluid, preferably with air. A plurality of weft yarns 71, 72, 73, 74 can be inserted simultaneously. A weft yarn distribution apparatus 9*a* supplies one of the weft yarn 71, 72, 73, 74 delivered to it into a respective sheds 103*a*, 103*b*, 103*c*, 103*d* which is currently open and. A a complete weft yarn insertion and the cutting of the weft yarn on the weft insertion side, the weft yarn tip or end thus created is guided to the next open shed.

Figure 5:
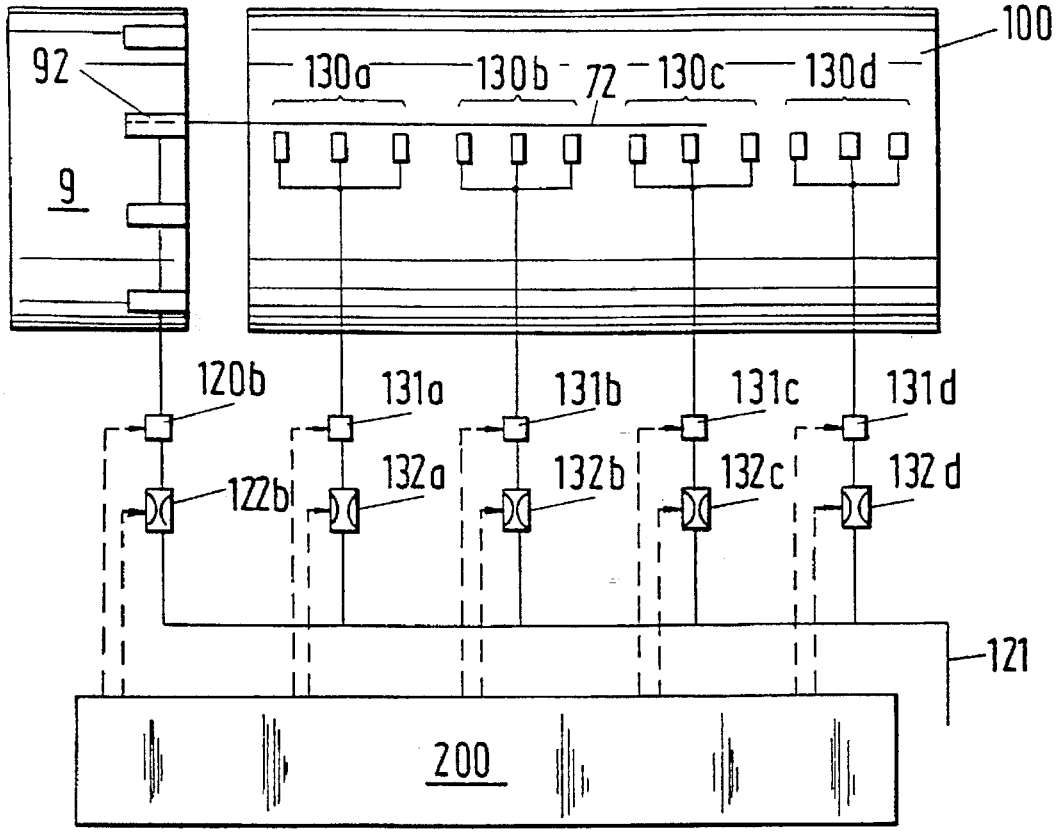
FIG. 5 schematically illustrates a series shed weaving machine with fluid nozzles and their fluid supply lines.

As is shown schematically in FIG. 5, the insertion of the weft yarn 72 into the weaving rotor 100 takes place by means of a fluid which is delivered via a fluid supply line 121. The weft yarn distribution apparatus 9 has a fluid nozzle 92 for each weft yarn 72 for conducting the weft yarn to and inserting it into an opened shed. The shed formation members 107 form a weft insertion channel in the opened shed which comprises relay nozzles 130*a*, 130*b*, 130*c*, 130*d* for carrying the weft yarn 72 with the support of a fluid through the shed. In the current embodiment, a control and feedback control apparatus 200 influences the pressure of the fluid by means of controllable restrictor valves 122*b*, 132*a*–132*d* and the switch-on and switch-off times of the fluid at the corresponding fluid nozzles 92, 130*a*–130*d* by means of controllable values 120*b*, 131*a*–131*d*. In the embodiment shown, the relay nozzles are arranged over the width of the weaving rotor 100 in four independent groups 130*a*–130*d*.

Figure 1:
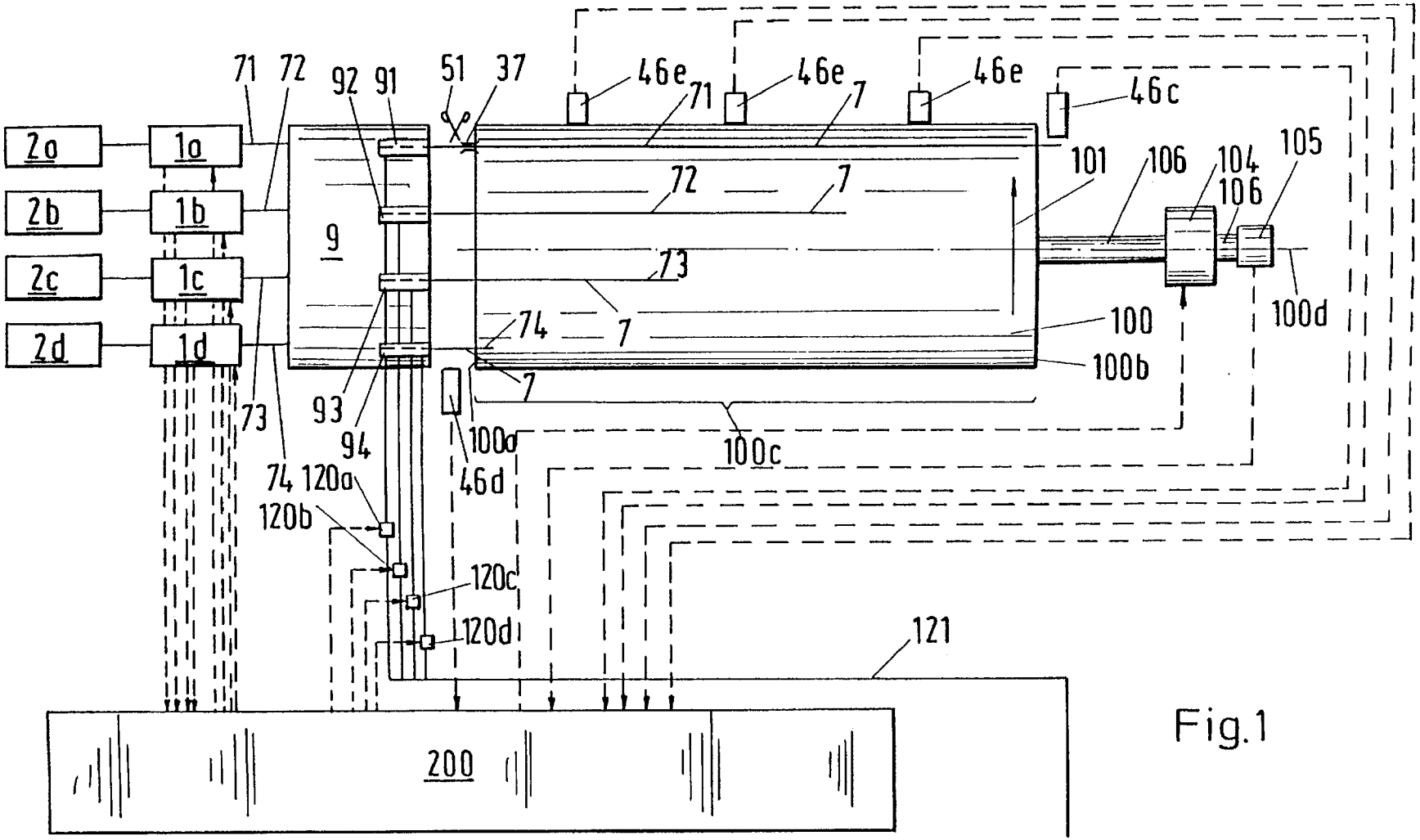
FIG. 1 shows a series shed weaving machine having a control apparatus.

FIG. 1 shows schematically the weft yarn insertion into a series shed weaving machine. Four weft yarns 7; 71, 72, 73, 74 are conveyed from four supply units 2*a*–2*d* and four metering apparatuses 1*a*–1*d* into the weft yarn distribution apparatus 9. The weft yarn distribution apparatus 9 distributes the weft yarns 71–74 delivered to it into the sheds of the weaving rotor 100 which are currently opened, with the weft yarns being inserted into the rotating weaving rotor 100 by stationary fluid nozzles 91, 92, 93, 94. A sensor 46*d* monitors the insertion of the weft yarn 74 into the weaving rotor 100 at the weft-insertion-side end 100*a* of the weaving rotor 100. The weft yarns 71, 72 and 73 are inserted or fired into the weaving rotor 100 in ascending order one after the other and are therefore correspondingly more or less fully inserted towards the weft-arrival-side end 100*b* of the weaving rotor 100. During weft insertion, the weaving rotor 100 moves in the direction of movement 101 so that the weft yarns 7 which are situated in the weaving rotor are simultaneously moved towards the weft yarn scissors 51 or yarn brake 37. In the position of the weaving rotor 100 shown, the weft yarn 71 is completely inserted in the weaving rotor 100, this fact being recognized by the sensor 46*c*. The weft yarn 71 is cut by the yarn scissors 51 at the weft insertion side and braked and held by the yarn brake 37. The new yarn tip or end arising therefrom is steered by the weft yarn distribution apparatus 9 to a further nozzle (not shown) and conducted into a newly formed shed which follows after the shed of weft yarn 74. Sensors 46*e* can be arranged along the shed in order to monitor the weft yarn 7 as it flies through the shed. A drive apparatus 104 which serves for driving the weaving rotor is connected via an axle 106 to the weaving rotor 100 and an angular sensor 105. A fluid line 121 supplies the fluid nozzles 91–94 with the fluid flow being interruptible via valves 120*a*–120*d*. All of the sensors 46*c*, 46*d*, 105 as well as the sensors of the metering apparatus 1*a*–1*d* are connected to a control and feedback control apparatus 200. All the actuators, the valves 120*a*–120*d*, the drive apparatus 104 and the metering apparatuses 1*a*–1*d* are also connected via signal lines to the control and feedback control apparatus 200. During normal operation of the series shed weaving machine, the weft yarn 71–74 is continuously pulled off from the weft yarn supply 2*a*–2*d* by the metering apparatus 1*a*–1*d* and is conveyed to the weft yarn distribution apparatus 9 which conducts the weft yarn 71–74 into an opened shed 103*a*–103*d*. For this, the speed of conveyance of the weft yarn 71–74 during insertion into the shed 103*a*–103*d* is determined by the metering apparatus 1*a*–1*d*. To do this, it is necessary to select the pressure of the fluid to be correspondingly large during weft yarn insertion so that the fluid nozzles 91 and the relay nozzles in the shed 103*a* exert a force acting in a weft insertion direction onto the weft yarn 71 in such a way that the weft yarn exerts a slight tensile force onto the metering apparatus 1*a*–1*d*. The insertion speed is thus determined by the metering apparatus 1*a*–1*d*. The amount of fluid, or the pressure of the fluid, required depends on the properties of the weft yarn 71 such as for example its roughness. If a weft yarn 71 is cut at the weft insertion side by the yarn scissors 51 after a complete weft yarn insertion, a new weft tip results which is steered through the weft yarn distribution apparatus 9 or the fluid nozzles 91–94 into a new, opened shed 103*a*–103*d*. The speed of insertion of the weft yarn 71 into the shed 103*a*–103*d* is once again determined by the metering apparatus 1*a*.

The control or feedback control of the weft yarn insertion is performed by the control and feedback control apparatus 200 which uses actuators to determine for example the rotational speed of the weaving rotor 100, the speed of insertion of the weft yarn, the switch-on and switch-off point of the fluid nozzles and the pressure of the fluid. The control or feedback control apparatus requires a reference or guide value to which the behavior of the other components is adjusted. For example, in the present embodiment, the angle of rotation or rotational speed of the weaving rotor 100 could be used as the guide value. This guide value can be prespecified by the control and feedback control apparatus 200 itself, for example as a clock signal to which all the components are synchronized. A guide value of this kind is also termed as the artificial guide shaft. The feedback control apparatus 200 controls the rotational angle or the rotational speed of the weaving rotor 100 via the drive apparatus 104 and the angle sensor 105 in such a manner that the rotational angle of the weaving rotor 100 agrees with the guide value. A guide value can however also be measured directly at the series shed weaving machine, for example as the signal of the angle sensor 105. If such a measured process parameter is used as the guide value, variations in the guide value feed through to the other components being controlled via the feedback control apparatus 200.

The series shed weaving machine can be operated in various modes by the control and feedback control apparatus 200.

In a first mode or method, a prespecified rotational speed is given to the weaving rotor 100 and, in relation to this, the metering apparatus 1*a*–1*d* synchronizes a speed of conveyance and the fluid nozzles 91–94 synchronize a time sequence for controlling the valves 120*a*–120*d*. In addition, the relay nozzles 130*a*–130*d* are continuously or intermittently actuated with a fluid. The fluid nozzles are driven in such a way that the insertion speed of the weft yarn is determined by the metering apparatus 1*a*–1*d*. The rotational speed of the weaving rotor and the rotational speed of the metering apparatus are fixed relative to one another with the weaving rotor rotating continuously during the weaving and the metering apparatus continuously conveying weft yarn. If a weft yarn is completely inserted, it is cut at the weft insertion side and the weft yarn tip newly formed thereby supplied to a new shed via the weft yarn distribution apparatus. As a result of the fixed synchronization of weaving rotor and metering apparatus, a complete weft yarn insertion is achieved without monitoring a process parameter. It can however be advantageous to monitor the weft yarn insertion with sensors 46*c*, 46*d*, 46*e* in order to determine insertion faults.

The prespecified rotational speed can be determined by the properties of the yarn or by other target parameters such as for example minimizing the fluid consumption of the nozzles.

In a second mode or method, process parameters are measured during the weaving process by the feedback control apparatus and are used to control the weaving process. The speed of insertion can thus be measured by a sensor arranged at the metering apparatus or with further sensors 4*c*, 4*d*, 4*e* arranged along the weft insertion. Also suitable as process parameters are, for example, the rotational angle or the rotational speed of the weaving rotor 100, or the length of weft yarns 71–74 inserted. The inserted length of weft yarns 71–74 can be measured or calculated by a sensor arranged at the metering apparatus 1*a*–1*d* which allows the location of the weft yarn tip to be determined during insertion and to be used as an additional control parameter. The fluid nozzles are in turn driven in such a manner that the insertion speed of the weft yarn can be determined by the metering apparatus 1*a*–1*d*.

Figure 2:
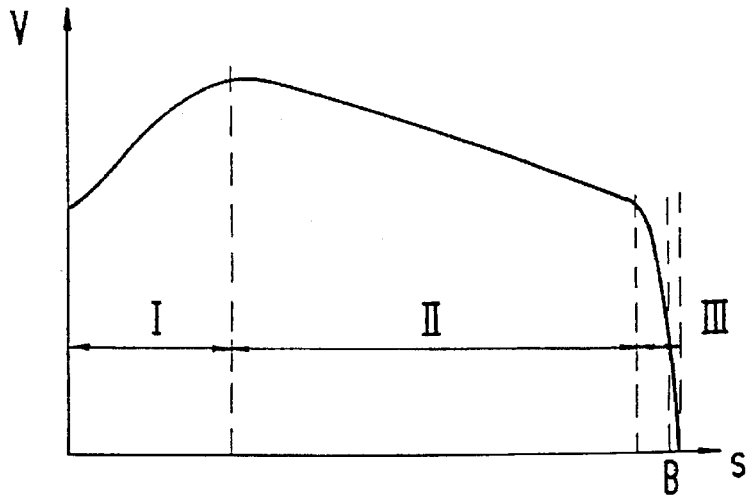
FIG. 2 is a diagram showing the weft yarn speed profile over the width of a weaving rotor.

In a further mode or method, the speed of insertion of the weft yarn is varied by the feedback control apparatus 200 in that the metering apparatus 1*a*–1*d* is driven with variable speed of conveyance, whereas the rotational speed of the weaving rotor 100 is held constant. An exemplary insertion speed profile V of the weft yarn tip as a function of the insertion path S is shown in FIG. 2. In the first phase of the insertion, phase I, the weft yarn experiences an acceleration whereas, in a second phase II, the insertion speed of the weft yarn reduces until, in a third phase III, the weft yarn is brought to rest through the action of the yarn brake 37 so that the weft yarn is inserted up to the width B of the weaving rotor 100. An advantage of this insertion method is that, as a result of the braking of the weft yarn in phase II, the weft yarn is stretched so that the weft yarn is inserted in a substantially stretched out condition. Due the modulation of the insertion speed as a function of insertion width, it is for example possible to optimize the air consumption or the weft insertion time in order to operate the weaving rotor at a rotational speed which is as high as possible.

Figure 3:
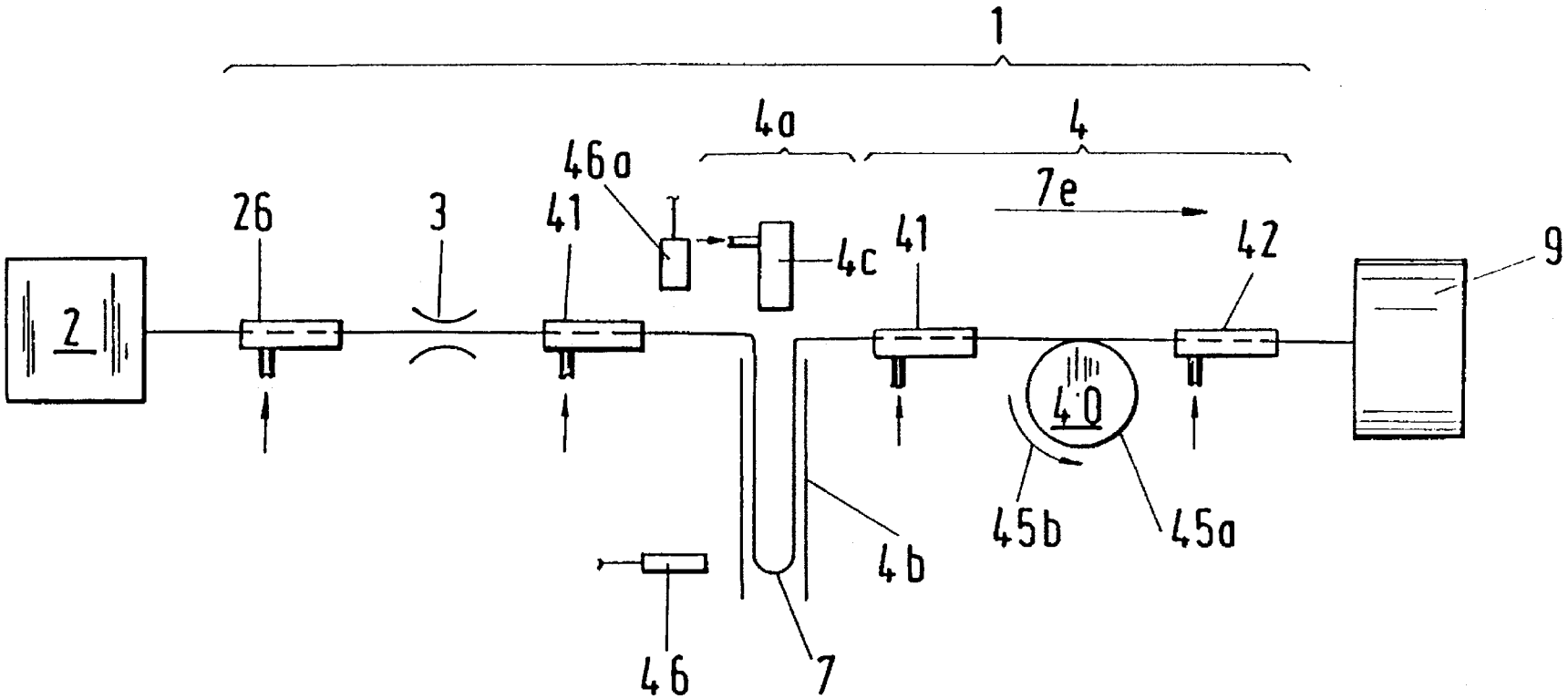
FIG. 3 shows a metering apparatus with a conveyor roller wound around with weft yarn.

A metering apparatus 1 is shown in FIG. 3 which pulls off a weft yarn 7 from a supply unit 2 and delivers it to a weft yarn distribution apparatus 9 or a series shed weaving machine in a manner matched to the weaving cycle.

The suction nozzle 26 conveys the weft yarn 7 to the right through a yarn brake 3 and via a weft yarn storage means 4*a* to a weft yarn conveyor apparatus 4. The storage apparatus 4*a* is formed as a tube 4*b* with a fluid nozzle 4*c* arranged above the upper tube opening thus allowing the weft yarn 7 to dip into the storage apparatus 4*b* and a sensor 46 to measure the stored length of yarn. An insertion nozzle 41 and a catcher nozzle 42 lying opposite to it in the weft insertion direction 7*e* define an insertion axis along which a weft yarn 7 is inserted into the weft yarn conveyor apparatus 4.

The weft yarn conveyor apparatus 4 has, between the insertion nozzle 41 and the catcher nozzle 42, a conveyor roller 40 which is part of the earlier discussed metering apparatus and has a support surface in the circumferential direction on which the weft yarn 7 lies. During conveying operation, the support surface is wound around many times by the weft yarn 7 so that, as a result, friction slippage between the conveyor roller 40 and the weft yarn 7 is avoided as much as possible so that the rotational speed of the conveyor roller determines the insertion speed of the weft yarn 7 and the length of weft yarn 7 inserted can be determined by measuring the rotation of the conveyor roller 40.

A weft yarn distribution apparatus 9 follows after the weft yarn conveyor apparatus 4 in the weft insertion direction 7*e*.

What is claimed is:

1. A method of inserting weft yarn into a shed formed by a series shed weaving machine comprising the steps of forming a fluid flow into the shed; entraining the weft yarn in the fluid flow to thereby advance the weft yarn into the shed; and controlling a speed with which the weft yarn is inserted into the shed independent of and at a location upstream of the fluid flow so that the weft yarn is inserted into the shed at a controlled speed and is subjected to tension.

2. A method according to claim 1 including the steps of monitoring a weaving process parameter during weaving, and determining the weft yarn insertion speed as a function of the parameter.

3. A method according to claim 1 wherein the series shed weaving machine includes a weaving rotor, and including the step of controlling the weft yarn insertion speed as a function of a rotational speed of the weaving rotor.

4. A method according to claim 2 wherein the weaving machine includes a weaving rotor, and wherein the step of monitoring comprises determining at least one of an angle of rotation and an angular velocity of the weaving rotor.

5. A method according to claim 2 wherein the step of monitoring comprises determining an insertion speed of the weft yarn.

6. A method according to claim 5 wherein the weaving machine includes a metering apparatus for advancing weft yarn to the shed, and wherein the step of controlling the insertion speed is performed by the metering apparatus.

7. A method according to claim 5 wherein the weaving machine includes a sensor which monitors the weft yarn in a region proximate an entrance to the shed, and wherein the step of monitoring the process parameter comprises utilizing a signal emitted by the sensor.

8. A method according to claim 2 wherein the weaving machine includes a sensor which monitors the weft yarn in a region proximate a side of the shed opposite a side thereof where the weft yarn enters the shed, and wherein the step of monitoring the process parameter comprises utilizing a signal generated by the sensor.

9. A method according to claim 2 wherein the step of monitoring comprises using a length of the weft yarn inserted into the shed as the process parameter.

10. A method according to claim 9 wherein the step of using the length comprises measuring the length of the weft yarn with a metering apparatus.

11. A method according to claim 2 wherein the step of monitoring the process parameter comprises providing a sensor which monitors the weft yarn in the shed, and using a signal generated by the sensor as the process parameter.

12. A method according to claim 11 wherein the weaving machine includes a metering apparatus, and including the step of varying an insertion speed of the weft yarn into the shed with the metering apparatus.

13. A method of inserting weft yarn into a shed formed by a series shed weaving machine comprising the steps of providing a fluid nozzle for generating a fluid flow into the shed; entraining the weft yarn in the fluid flow to thereby advance the weft yarn into the shed; controlling a speed with which the weft yarn is inserted into the shed independent of and at a location upstream of the fluid flow so that the weft yarn is inserted into the shed at a controlled speed and is subjected to tension; and activating and deactivating the fluid nozzle as a function of at least one of a type of weft yarn being inserted, a rotational speed of a weaving rotor of the weaving machine, and a weaving process parameter measured during weaving.

14. A method according to claim 13 wherein the step of activating and deactivating comprises at least one of controlling a duration during which the fluid is discharged by the nozzle and a pressure of the fluid in the nozzle.

15. A method according to claim 13 including the step of providing relay nozzles and with the relay nozzles generating additional fluid flows for advancing the weft yarn over a length of the shed.

16. A method according to claim 15 including the step of controlling the additional fluid flows by determining a desired activation and deactivation of the fluid flows as a function of at least one of a kind of weft yarn, a rotational speed of a rotor of the weaving machine, and a weaving process parameter measured during weaving.

17. A method of inserting weft yarn into a shed formed by a series shed weaving machine, the weaving machine including a metering apparatus, comprising the steps of establishing a desired speed profile for the insertion of the weft yarn into the shed; presetting the speed profile prior to the insertion of the weft yarn into the shed; forming a fluid flow into the shed; entraining the weft yarn in the fluid flow to thereby advance the weft yarn into the shed; and controlling a speed with which the weft yarn is inserted into the shed independent of and at a location upstream of the fluid flow so that the weft yarn is inserted into the shed at a controlled speed and is subjected to tension, the speed controlling step including the step of varying an insertion speed of the weft yarn into the shed with the metering apparatus.

18. A method of inserting weft yarn into a shed formed by a series shed weaving machine, the weaving machine including a metering apparatus, comprising the steps of forming a fluid flow into the shed; entraining the weft yarn in the fluid flow to thereby advance the weft yarn into the shed so the weft yarn is inserted into the shed in first and second insertion phases; controlling a speed with which the weft yarn is inserted into the shed independent of and at a location upstream of the fluid flow so that the weft yarn is inserted into the shed at a controlled speed and is subjected to tension; the speed controlling step including the step of varying an insertion speed of the weft yarn into the shed with the metering apparatus; the step of varying comprising the steps of increasing a weft yarn insertion speed during the first insertion phase and reducing the weft yarn insertion speed during the second insertion phase.

* * * * *